US009474958B2

(12) United States Patent
Shigeta

(10) Patent No.: US 9,474,958 B2
(45) Date of Patent: Oct. 25, 2016

(54) CARD-READING DEVICE AND TABLE-GAME SYSTEM

(71) Applicant: Angel Playing Cards Co., Ltd., Shiga (JP)

(72) Inventor: Yasushi Shigeta, Kyoto (JP)

(73) Assignee: Angel Playing Cards Co., Ltd., Shiga (JP)

( * ) Notice: Subject to any disclaimer, the term of this patent is extended or adjusted under 35 U.S.C. 154(b) by 157 days.

(21) Appl. No.: 14/396,716

(22) PCT Filed: Apr. 23, 2013

(86) PCT No.: PCT/JP2013/002742
§ 371 (c)(1),
(2) Date: Oct. 23, 2014

(87) PCT Pub. No.: WO2013/161284
PCT Pub. Date: Oct. 31, 2013

(65) Prior Publication Data

US 2015/0097335 A1 Apr. 9, 2015

(30) Foreign Application Priority Data

Apr. 23, 2012 (JP) ..... 2012-111914

(51) Int. Cl.
*A63F 1/14* (2006.01)
*A63F 1/12* (2006.01)
*A63F 9/24* (2006.01)

(52) U.S. Cl.
CPC .. *A63F 1/14* (2013.01); *A63F 1/12* (2013.01); *A63F 2009/2445* (2013.01)

(58) Field of Classification Search
CPC ..... A63F 1/14; A63F 2009/2445
USPC ..... 273/149 R, 149 P; 463/22
See application file for complete search history.

(56) References Cited

U.S. PATENT DOCUMENTS 5,941,769 A * 8/1999 Order ..... A63F 1/18 273/149 R
8,170,323 B2 * 5/2012 Downs, III ..... 273/148 A
(Continued)

FOREIGN PATENT DOCUMENTS

CN 1933881 A 3/2007
CN 101854982 A 10/2010
(Continued)

OTHER PUBLICATIONS

International Application No. PCT/JP2013/002742, International Search Report mailed Jul. 30, 2013.
International Application No. PCT/JP2013/002742, Written Opinion mailed Jul. 30, 2013.
Chinese Patent Application No. 201380021209.X, Office Action mailed Jul. 22, 2016.

*Primary Examiner* — Benjamin Layno
(74) *Attorney, Agent, or Firm* — Sheppard, Mullin, Richter & Hampton LLP

(57) ABSTRACT

A card shooter apparatus of a table game system is provided with a card shooter unit having a card housing unit that stores a plurality of cards in a horizontally stacking manner, and a control device configured with a program storage unit, a computer device, etc. is arranged at a lower part of the card shooter apparatus. A lid is provided at an upper part of the card housing unit, and an optical sensor that receives reflected light of light irradiated to end surfaces of the plurality of cards stored in the card housing unit is arranged under the lid. The card shooter apparatus and the table game system make it possible to inspect that the plurality of cards complete a predetermined number (for example, 416 cards in the case of eight decks) in a state of being present in the card shooter apparatus.

26 Claims, 7 Drawing Sheets

(56) References Cited

U.S. PATENT DOCUMENTS

| | | | | |
|---|---|---|---|---|
| 8,899,588 | B2 * | 12/2014 | Shigeta | A63F 1/14 273/149 R |
| 2004/0026636 | A1 | 2/2004 | Shigeta | |
| 2005/0121852 | A1 * | 6/2005 | Soltys | A63F 1/18 273/149 P |
| 2005/0156046 | A1 | 7/2005 | Goldenberg | |
| 2005/0248088 | A1 | 11/2005 | Yoshida et al. | |
| 2006/0219797 | A1 | 10/2006 | Koyama et al. | |
| 2008/0182636 | A1 | 7/2008 | Yoshida et al. | |
| 2008/0188313 | A1 | 8/2008 | Yoshida et al. | |
| 2008/0224394 | A1 | 9/2008 | Shigeta | |
| 2011/0034243 | A1 * | 2/2011 | Shigeta | A63F 1/14 463/29 |
| 2011/0079956 | A1 * | 4/2011 | Emori | A63F 1/14 273/149 R |
| 2012/0018951 | A1 | 1/2012 | Just | |
| 2013/0277911 | A1 * | 10/2013 | Shigeta | A63F 1/14 273/149 R |
| 2013/0303277 | A1 | 11/2013 | Shigeta | |

FOREIGN PATENT DOCUMENTS

| | | |
|---|---|---|
| JP | 3674560 | 7/2005 |
| JP | 2006271596 | 10/2006 |
| JP | 2012061023 | 3/2012 |
| WO | 02064225 | 8/2002 |
| WO | 2005067384 | 7/2005 |
| WO | 2012035742 | 3/2012 |

* cited by examiner

FIG.5

| Combination | Arrangement of marking | Outputs of sensors |
|---|---|---|
| 1 | Blank<br>Blank | OFF<br>OFF |
| 2 | Blank<br>M | OFF<br>ON OFF |
| 3 | M<br>Blank | ON OFF<br>OFF |
| 4 | M<br>M | ON OFF<br>ON OFF |

CARD-READING DEVICE AND TABLE-GAME SYSTEM

CROSS-REFERENCE TO RELATED APPLICATIONS

This application is a national stage application pursuant to 35 U.S.C. §371 of International Application No. PCT/JP2013/002742, filed Apr. 23, 2013, which claims priority to Japanese Patent Application No. 2012-111914, filed Apr. 23, 2012, the disclosures of which are hereby incorporated by reference herein.

TECHNICAL FIELD

The present invention relates to a card shooter apparatus that is placed and used on a table in a table game and a table game system that uses the card shooter apparatus, and further, to a card shooter apparatus that is provided with a card housing unit that stores a plurality of cards in a horizontally stacking manner, has a card shooter unit that performs progress of a game by a dealer sliding and taking out the cards from the card housing unit and dealing them onto a game table, and is provided with a function to determine whether or not the cards stored in the card housing unit complete a predetermined number and to prevent a fraudulent act, and a table game system.

BACKGROUND ART

In Patent Literature 1, there is disclosed an apparatus that detects that a plurality of cards used in a table game complete a certain number of cards neither more nor less. In Patent Literature 1, there is disclosed a technology to detect whether or not a card deck used in the table game is a predetermined one by reading a code indicating a type of the card, the code being provided in the card.

In addition, in Patent Literature 2, there is disclosed a technology in which information to specify a card is input to an IC etc., the IC etc. are embedded in the card together with an antenna that radiates electromagnetic waves, and in which the card can be remotely specified.

In the above-described conventional apparatus, the stacked cards are delivered by a roller etc. for each card, and each UV code of the separated card is read to inspect the card, whereby fraud is prevented. In a table game, for example, a baccarat game, a plurality of decks, for example, usually six or eight decks are stored in a card shooter apparatus, and placed and used on a table, and casino regulations, etc. in each country require that the plural decks of cards in the card shooter apparatus complete a predetermined number (416 cards in a case of eight decks) before start of the game. Furthermore, a strict rule may be applied in which when it turns out that the plural decks of cards put in the card shooter apparatus do not complete the predetermined number (416 cards in the case of eight decks) at the end of the game, all the games performed by the card shooter apparatus are void. However, since the cards are separated for each card by the roller etc. to measure the number of cards and inspect the cards in the above-described conventional apparatus, it cannot be inspected that the cards complete the predetermined number (416 cards in the case of eight decks) in a state where the plurality of cards are stored in the card shooter apparatus in a stacking manner.

In addition, if the card in which the IC etc. are embedded and that can be remotely specified is used, the plurality of cards can be inspected from a remote location in a state of being present in the card shooter apparatus. However, such remote reading of information includes a possibility that the information of the card is stolen by an advanced hacking technology and is fraudulently used in the game, and thus it cannot be used for the table game.

CITATION LIST

Patent Literature

Patent Literature 1
International Publication No. WO 02/064225
Patent Literature 2
Japanese Patent Laid-Open No. 2006-271596

SUMMARY OF INVENTION

Technical Problem

The present invention has been made under the above-described background. An object of the present invention is to provide a card shooter apparatus and a table game system that allow to inspect that a plurality of cards complete a predetermined number (for example, 416 cards in a case of eight decks) in a state of being stored in the card shooter apparatus in a stacking manner. In addition, the object of the present invention is further to provide a card shooter apparatus and a table game system that can determine that a fraudulent card is mixed in a state where a plurality of cards are present in the card shooter apparatus.

Solution to Problem

One aspect of the present invention is a card shooter apparatus, and the card shooter apparatus includes: a card shooter unit provided with a card housing unit that stores a plurality of cards in a horizontally stacking manner, and an opening through which the cards are slid and taken out onto a game table from the card housing unit; an optical sensor that receives reflected light of light irradiated to end surfaces of the plurality of cards stored in the card housing unit; a playing card number counting unit that receives a signal of the optical sensor to count the number of the plurality of cards stored in the card housing unit; and a number count determination unit that determines whether or not the number of the plurality of cards stored in the card housing unit completes a predetermined number by an output of the playing card number counting unit, and outputs a result, wherein the optical sensor is arranged at an upper unit of the card housing unit, is arranged over a stacking direction of the plurality of cards so as to be able to receive the reflected light from the end surfaces of the stored plurality of cards, and wherein the optical sensor is further provided with scanning means that moves the optical sensor.

As explained hereinafter, there are other aspects in the present invention. Accordingly, this disclosure of the invention is intended to provide some aspects of the present invention, and is not intended to limit the scope of the invention described and claimed herein.

BRIEF DESCRIPTION OF DRAWINGS

FIG. 5 is a table showing a relation between output waveforms of sensors and a mark in the card shooter apparatus in the embodiment of the present invention.

DESCRIPTION OF EMBODIMENT

Figure 1:
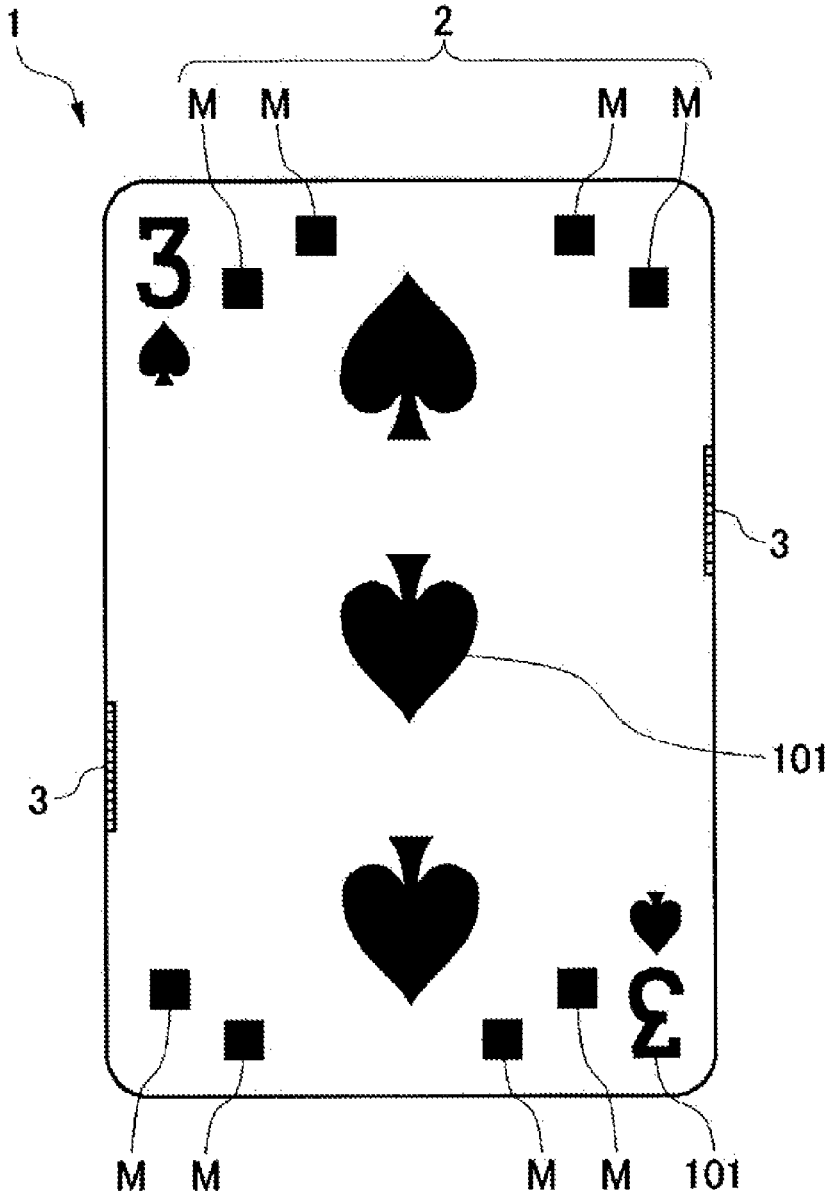
FIG. 1 is a plan diagram of a card in an embodiment of the present invention.

Detailed explanation of the present invention will be mentioned hereinafter. However, the following detailed explanation and accompanying drawings do not limit the invention.

In order to solve the above-described conventional problem, a card shooter apparatus of the present invention includes: a card shooter unit provided with a card housing unit that stores a plurality of cards in a horizontally stacking manner, and an opening through which the cards are slid and taken out onto a game table from the card housing unit; an optical sensor that receives reflected light of light irradiated to end surfaces of the plurality of cards stored in the card housing unit; a playing card number counting unit that receives a signal of the optical sensor to count the number of the plurality of cards stored in the card housing unit; and a number count determination unit that determines whether or not the number of the plurality of cards stored in the card housing unit completes a predetermined number by an output of the playing card number counting unit, and outputs a result, wherein the optical sensor is arranged at an upper part of the card housing unit, is arranged over a stacking direction of the plurality of cards so as to be able to receive the reflected light from the end surfaces of the stored plurality of cards, and wherein the optical sensor is further provided with scanning means that moves the optical sensor.

In addition, furthermore, in the card shooter apparatus of the present invention, further, the playing card number counting unit may be configured to decide the number of the plurality of cards based on information of white portions, etc. obtained from the optical sensor concerning minute gaps among the plurality of cards stored and stacked in the card housing unit or black portions that are present in the cards, or both the minute gaps and the black portions.

Furthermore, in order to solve the above-described conventional problem, a table game system of the present invention is the table game system including: cards configured so that a striped pattern appears on side surfaces of the plurality of cards when the plurality of cards are stacked; and a card shooter apparatus provided with a card housing unit that stores the plurality of cards in a stacking manner, and a card shooter unit that has an opening through which the cards are slid and taken out onto a game table from the card housing unit, wherein the card shooter apparatus includes: the card shooter unit provided with the card housing unit that stores the plurality of cards in a horizontally stacking manner, and the opening through which the cards are slid and taken out onto the game table from the card housing unit; an optical sensor that receives reflected light of light irradiated to end surfaces of the plurality of cards stored in the card housing unit; a playing card number counting unit that receives a signal of the optical sensor to count the number of the plurality of cards stored in the card housing unit; a number count determination unit that determines whether or not the number of the plurality of cards stored in the card housing unit completes a predetermined number by an output of the playing card number counting unit, and outputs a result; a side surface pattern storage device that stores a particular predetermined striped pitch or color that appears on side surfaces of the plurality of cards when the plurality of cards are stacked; and a fraudulent card detection unit that compares reflected light of light of the card side surfaces obtained from the optical sensor with the predetermined striped pitch or color, and determines and outputs whether or not a fraudulent card or a defective card is mixed in the plurality of cards stored in the card housing unit, wherein the optical sensor is arranged at an upper part of the card housing unit, is arranged so as to be able to receive the reflected light from the end surfaces of the stored plurality of cards, and wherein the optical sensor is further provided with scanning means that moves the optical sensor.

In addition, the optical sensor, the scanning means, the fraudulent card detection unit, and a group information sensor may be provided at the lid arranged at the upper part of the card housing unit.

According to the card shooter apparatus of the present invention, it becomes possible to inspect that the plurality of cards complete the predetermined number (for example, 416 cards in the case of eight decks) in the state of being stored in the card shooter apparatus in the stacking manner, and further, it is possible to determine that the fraudulent card is mixed in the state where the plurality of cards are stored in the card shooter apparatus in the stacking manner.

Embodiment 1

Hereinafter, an embodiment of a game system of the present invention will be explained in detail. FIG. 1 shows a card 1 used for the game system of the embodiment, and a code 2 configured with usually invisible marks M into which numeric characters are coded is point-symmetrically provided at an upper side and a lower side of the card 1. The code 2 is configured with a combination of the number and arrangement of the plurality of marks M printed in infrared reactive ink or ultraviolet reactive ink invisible under daylight. In addition, at ends of long sides of the card 1, provided is authenticity determination group information 3 in which information indicating authenticity of the card is coded and that are arranged by printing etc. in a usually invisible state (for example, ultraviolet reactive ink). The code 2 is arranged at least at two places of the card 1, and they are arranged at positions point-symmetrical to a center of the card.

Figure 2:
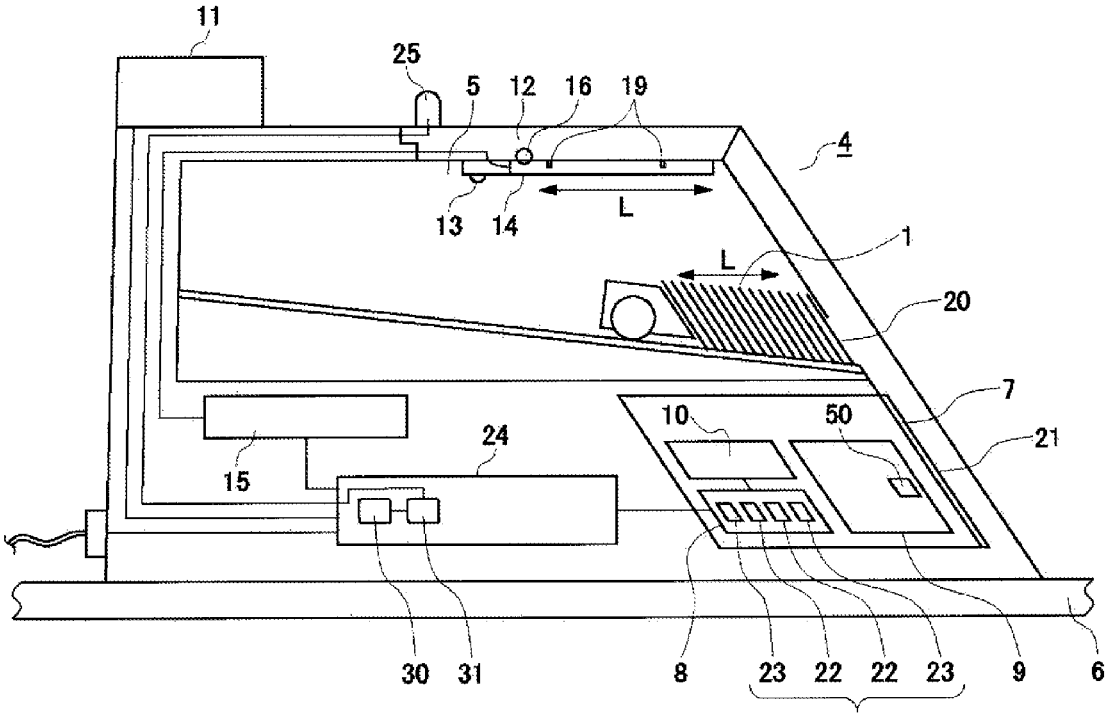
FIG. 2 is a block diagram showing an entire card shooter apparatus of the embodiment of the present invention.
Figure 3:
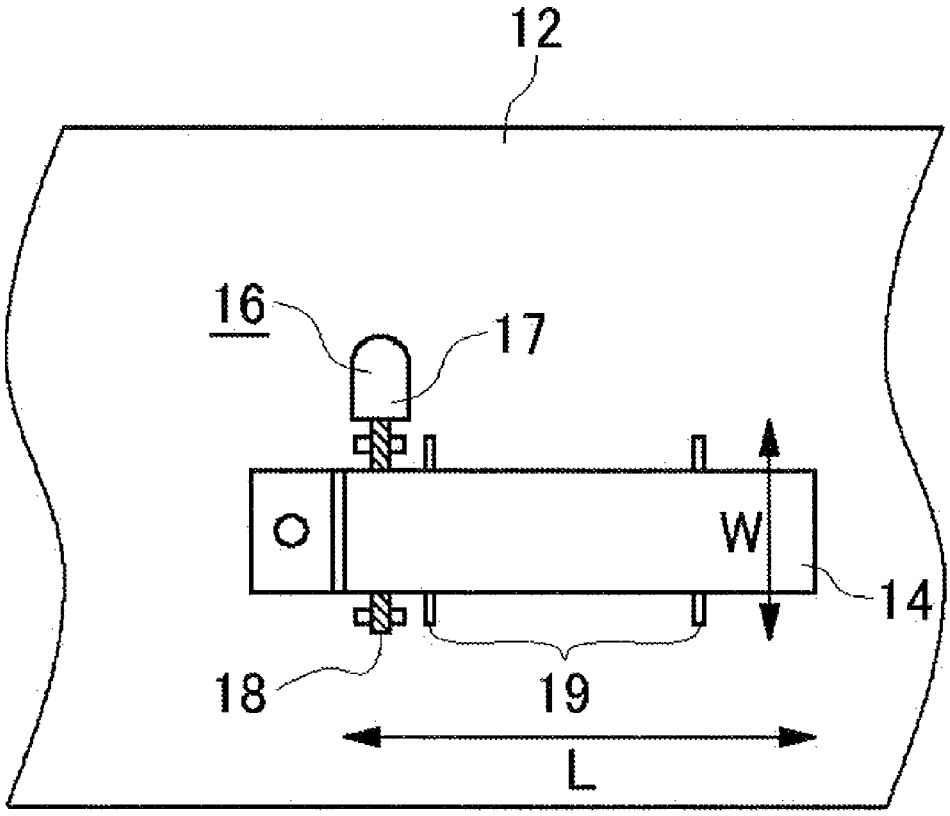
FIG. 3 is a bottom diagram of a lid of the card shooter apparatus in the embodiment of the present invention.

FIG. 2 is a schematic configuration diagram showing an entire card shooter apparatus used for the game system of the embodiment, and shows a card shooter apparatus 4 that has a card reading function to read the code 2 of the card 1 used for a game. The card shooter apparatus 4 includes: a card guide unit 7 that guides onto a game table 6 the card 1 pulled out from a card housing unit 5 one by one by a hand of a dealer of a casino, etc.; a code reading unit 8 that reads from the card 1 the code 2 indicating a numeric character (a number, a rank) of the card 1, in the card 1 being pulled out from the card housing unit 5; an authenticity determination unit 9 that determines authenticity of the card from information on the authenticity of the card; a win or loss determination unit 10 that determines win or loss of a card game based on the number of the card 1 sequentially read by the code reading unit 8; and output means 11 that outputs a determination result of the win or loss determination unit 10 and a determination result of the authenticity determination unit 9.

A bunch of the cards is pressed forward by a card pressing block in the card housing unit 5. The card pressing block may be a card pushing member with a roller as shown in FIG. 2, or may be a member (not shown) that operates back and forth by an air cylinder.

The table game system of the present invention may use a card inspection apparatus (not shown) in which the card shooter unit has been omitted from the card shooter apparatus 4 instead of the card shooter apparatus 4. The card inspection apparatus can be used not only for the table game together with a usual card shooter, but can be used for card inspection in a backyard or a card manufacturing site.

Next, a playing card number counting function provided at the card shooter apparatus 4 will be explained. A lid 12 is removably provided at an upper part of the card housing unit 5 in order to store and take out the plurality of cards 1 in/from the card housing unit 5. At a lower part of the lid 12, provided are a light source 13 (an LED etc.) for irradiating light to end surfaces of the plurality of cards stored in the card housing unit 5, and an optical sensor 14 that receive reflected light (images of the card end surfaces) of the light irradiated to the end surfaces of the cards 1 by the light source 13. Note that a CCD used for a well-known camera and copying machine is used as the optical sensor 14. A signal of the optical sensor 14 is image-processed (details of the image processing will be mentioned later) in a playing card number counting unit 15, and the number of the plurality of cards stored in the card housing unit 5 is counted. The optical sensor 14 is arranged at the lid 12 of the upper part of the card housing unit 5, and is arranged over a stacking direction (an arrow L) of the plurality of cards so as to be able to simultaneously receive the reflected light (images) from the end surfaces of all the stored plurality of cards 1.

Furthermore, at the lower part of the lid 12, provided is scanning means 16 that moves the optical sensor 14 by a predetermined distance in a direction perpendicular to the stacking direction (arrow L) of the plurality of cards 1. The optical sensor 14 arranged at the lid 12 of the upper part of the card housing unit 5 is arranged to have a predetermined length over the stacking direction (arrow L) of the plurality of cards so as to be able to simultaneously receive the reflected light (images) from the end surfaces of all the stored plurality of cards, and further, the optical sensor 14 is moved in the direction perpendicular to the stacking direction (arrow L) of the cards 1 by the scanning means 16, and thereby the obtained image changes from a line to a two-dimensional surface. Consequently, the embodiment has an advantage that the image processing (details of the image processing will be mentioned later), which will be mentioned later, can be performed more accurately in the playing card number counting unit 15. The scanning means 16 has a structure that moves the optical sensor 14 in the direction perpendicular to the stacking direction (arrow L) of the cards 1 (a direction perpendicular to a paper surface of FIG. 1) by a predetermined distance by a drive shaft 18 provided with a spiral groove that is rotationally driven by a motor 17. The optical sensor 14 is guided by guide means 19, such as a rail, in the lower part of the lid 12, and can be moved in the direction perpendicular to the stacking direction (arrow L) of the cards 1 (the direction perpendicular to the paper surface of FIG. 1) by a predetermined distance W.

Note that in order to increase accuracy of image processing of number count, it is preferable that the plurality of cards 1 stored in the card housing unit 5 are set in the card housing unit 5 in a state of being stored in an inner box (not shown), the cards 1 are in a stacked erect state at the time of the number count, and that the inner box is removed after the end of the number count. The number count determination unit in a control device (mentioned later) is informed of a number measurement value of the playing card number counting unit 15, it is determined whether or not the number of the plurality of cards stored in the card housing unit 5 is a predetermined number, and a determination result is displayed by the output means 11 and is also sent to an external central control pit (not shown).

Figure 4:
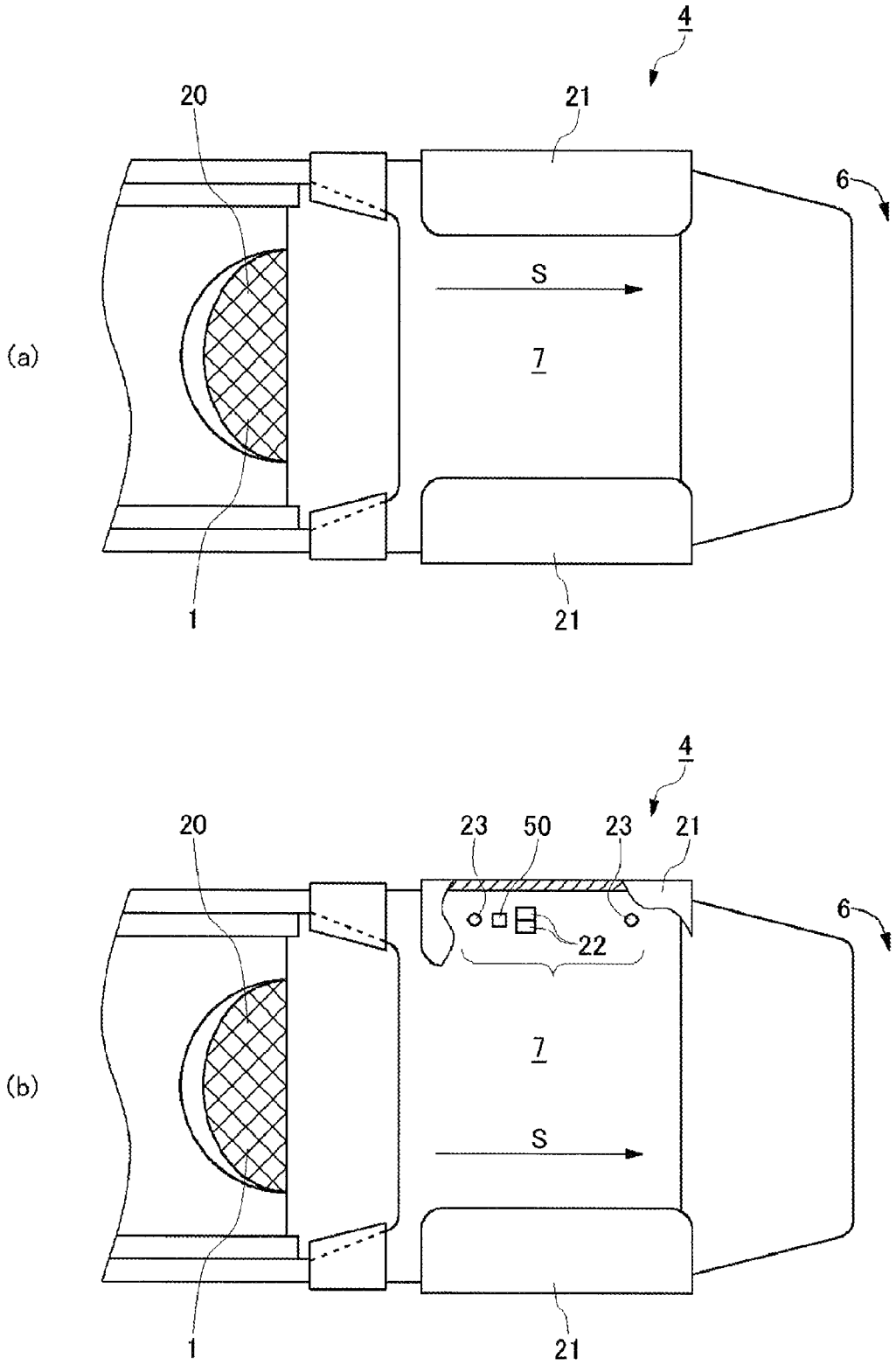
FIG. 4(*a*) is a plan diagram of a main portion of the card shooter apparatus in the embodiment of the present invention, and FIG. 4(*b*) is a plan diagram of the main portion of the card shooter apparatus in the embodiment of the present invention in a state where a sensor cover is removed from the card shooter apparatus.

Next, by FIG. 4, will be explained detailed configuration of operation that reads from the card 1 the code 2 indicating a numeric character (a number, a rank) of the card 1, in the card 1 being pulled out from the card housing unit 5. FIG. 4 is a plan diagram of a main portion for illustrating a configuration of the card shooter apparatus 4. In FIG. 4, the cards 1 are taken out one by one from an opening 20 of a front of the card housing unit 5, are guided by the card guide unit 7, and are dealt onto the game table 6. The card guide unit 7 is an inclined surface, and a card guide rail 21 that doubles as a sensor cover is attached to edges of both sides of the card guide unit 7. In addition, each of the two card guide rails 21 is attachable and removable by a screw (not shown) etc. As shown in FIG. 4, when the card guide rail 21 is removed, a sensor group of the code reading unit 8 is exposed. The sensor group includes four sensors, and is configured with two ultraviolet reactive sensors (UV sensors) 22 and two object detection sensors 23.

The object detection sensor 23 is the sensor that detects presence/absence of the card 1. One of the object detection sensors 23 is located at an upstream side along a flow direction S of the card 1 of the card guide unit 7, and the other object detection sensor 23 is located at a downstream side. As shown in FIG. 4, both the object detection sensors 23 are provided at the upstream side and the downstream side across the UV sensor 22. The UV sensor 22 is provided with an LED (ultraviolet LED) that emits an ultraviolet ray, and a detector. The codes M are printed on the card 1 in ultraviolet ray emission ink that develops a color when subjected to an ultraviolet ray, the ultraviolet ray (black light) is irradiated to the card 1, and reflected light of the marks M of the code 2 of the card 1 is detected by the detector. The UV sensor 22 is connected to the code reading unit 8 through a cable. In the code reading unit 8, a combination of the marks M is determined from output signals of the detectors of the two UV sensors 22, and a number (rank) corresponding to each code 2 is determined. The code reading unit 8 is connected to a control device 24 (control box).

Start and end of reading of the UV sensor 22 in the code reading unit 8 are controlled by the control device 24 based on a detection signal of the object detection sensor 23. In addition, the control device 24 also determines whether or not the card 1 has normally passed through the card guide unit 7 based on the detection signal of the object detection sensor 23. In the embodiment shown in FIG. 1, the square mark M indicating a rank (number) and a suit (a heart, a spade, etc.) of the card is arrayed at an edge of the card 1 by two columns and four rows. As shown in FIG. 5, the two UV sensors 22 output ON signals when detecting the marks M.

A relative relation between both signals input from the two UV sensors 22 is determined in the code reading unit 8. Consequently, by a relative difference etc. of the two marks M detected by the two UV sensors 22, the code reading unit 8 specifies a code, and specifies the number (rank) and a type (suit) of the corresponding card 1.

A relation between the code 2 and the outputs of the ON signals of the two UV sensors 22 is shown in FIG. 5. A predetermined combination of the marks M can be specified based on a comparison result of relative change of the outputs of the ON signals of the UV sensors 22. As a result, in an example shown in FIG. 1, when four types of combinations as combinations of the marks M of two upper and lower columns are printed by four columns, the fourth power of the four types of combinations, i.e., 256 types of codes can be configured. The embodiment is configured such that 52 types of playing cards are allocated to any of 256 types of codes, respectively, they are stored in a form of a memory or a program as a comparative table, and the code reading unit 8 specifies each code 2, whereby the number (rank) and the type (suit) of the card 1 are specified from the predetermined comparative table (not shown). In addition, since 256 types of codes can be made to correspond to 52 types of cards using a free combination to thereby be stored by the comparative table, the combination can be complicated, and the combination of 256 types of codes and 52 types of cards can be changed by time or location. The code 2 is arranged at least at two places of the card 1, and those codes are point-symmetrical to a center of the card. It is desirable that the codes are printed with paint visualized by receiving ultraviolet light, and are printed at positions that do not overlap with a type notation of the card or an index 102. In addition, a blank portion is provided between the code and an end of the playing card.

Here, a configuration of the control device 24 will be explained. The control device 24, the code reading unit 8, the win or loss determination unit 10, etc. are computer devices, for example, a processing function (the win or loss determination unit 10) to automatically determine win or loss of a game is achieved by incorporating a program for win or loss determination in a computer, and the program is executed by a processor of the computer. The number of cards sequentially taken out onto the game table 6 is acquired using the UV sensor 22 in the code reading unit 8, and the number of acquired cards is sequentially stored in the memory. At this time, information of which player each card 1 was dealt to is also stored. The number of cards is stored in association with the player of a deal destination. Players and a banker are present in a baccarat game. A rank (number) of the cards dealt to each player in association with him is stored in the memory, the ranks (numbers) of the cards dealt to both players are totaled, and it is determined which player has won from programmed game rules. A draw is also determined.

Figure 6:
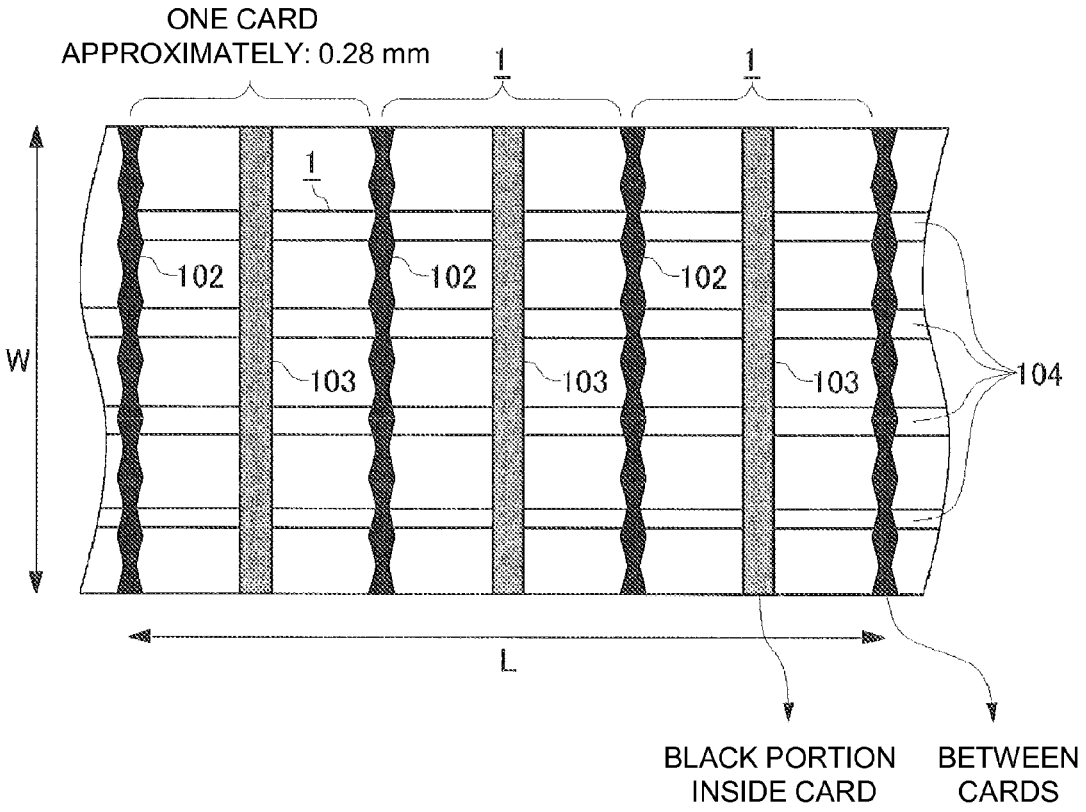
FIG. 6 is an explanatory diagram of an image obtained from an optical sensor in the card shooter apparatus in the embodiment of the present invention.

Next, processing of image information of the card 1 obtained by the optical sensor 14 will be mentioned. FIG. 6 shows one example where an enlarged two-dimensional image obtained by moving the optical sensor 14 in the direction W perpendicular to the stacking direction (arrow L) of the cards 1 by a predetermined distance by the scanning means 16. Side portions of an upper surface of the card 1 are white, a gap 102 between the cards 1 is black since light is not reflected, or as for a black portion 103 present in the middle of each card 1, a black or gray signal is obtained. A thickness (for example, approximately 0.28 mm) of the card 1 for each card is known, and a black signal of the gap 102 between the respective cards 1, or the black or gray signal of the black portion 103 present in the middle of each card 1 is detected, or a relative difference in color, a difference in luminance, etc. from the minute gap 102 and the black portion 103 are detected. The number of minute gaps and black portions that decide the number of the plurality of cards is counted based on information on the above-described differences in luminance and color, the information being obtained from the optical sensor 14, and thereby the total number of the plurality of cards 1 stored in the card housing unit 5 is obtained.

Next, there will be explained configurations and operation of the side surface pattern storage device that stores a particular predetermined striped pitch or color that appears on side surfaces of the plurality of cards when the plurality of cards are stacked, and the fraudulent card detection unit that compares reflected light of light of the card side surfaces obtained from the optical sensor with the predetermined striped pitch or color, and determines and outputs whether or not a fraudulent card or a defective card is mixed in the plurality of cards stored in the above-described card housing unit.

A check or a striped pattern is usually printed on the card 1 as a back surface design. In the example of the present invention, the cards 1 is configured so that a striped pattern 104 appears on side surfaces of the plurality of cards when the plurality of cards are stacked. The striped pattern 104 is decided by a pattern of the back surface design of the card 1, and the card 1 is configured so that the striped pattern 104 appears by printing the pattern of the back surface design to the edge of the card, or by an individual card punching direction (punching from a back side to a front side, etc.). As described above, the card 1 is configured so that the pattern appears on side surfaces of the plurality of cards when the plurality of cards are stacked, and the predetermined striped pitch or color is stored in a side surface pattern storage device 30. The striped pattern 104 of the side surfaces is included in the reflected light of the light of the card side surfaces that is obtained by the optical sensor 14. Since a different striped pattern appears when the fraudulent card or the defective card is mixed in the plurality of cards 1 stored in the card housing unit 5, it can be determined whether or not the fraudulent card or the defective card is mixed by comparing the striped pattern 104 of the side surfaces with the previously stored striped pitch or color. The embodiment is configured such that a fraudulent card detection unit 31 performs the determination and outputs a result to a display device 25.

Next, there will be explained the authenticity determination unit 9 that determines authenticity of the card from information on the authenticity of the card. The authenticity determination group information 3 configured in a usually invisible state (for example, ultraviolet reactive ink) by coding information indicating authenticity of the card is, as shown in FIG. 1, provided in the card 1, which is an object of the authenticity inspection. The authenticity determination group information 3 is printed and attached to a same position at least in a set of cards. The authenticity determination group information 3 is configured with a substance or a material itself that emits light of a different wavelength spectrum to light of a different wavelength as a code. More specifically, the substance or the material that configures an authenticity determination code, which is the authenticity determination group information 3, is configured so that intensities of light in two different wavelengths that are emitted when light of different wavelengths are irradiated to a region where the authenticity determination group information 3 has been provided are different from each other. As the substance or the material that emits light of a different wavelength spectrum to invisible light of different wavelengths (an ultraviolet ray, an infrared ray, etc.), a polymeric material or a DNA material, etc. having a molecular structure that emits a particular wavelength to light is used. The polymeric material having the molecular structure that emits the particular wavelength to the light is printed at two places of long sides of the card 1 as authenticity determination group information as shown in FIG. 1. The authenticity determination group information 3 cannot be discriminated by human sense of vision under a usual usage condition (daylight, natural light, etc.).

The authenticity determination unit 9 of the card shooter apparatus 4 is provided with a function to irradiate invisible light of different wavelengths to the authenticity determination group information 3, and determine whether or not ratios of light intensities in at least two different wavelengths of two light emitted from the authenticity determination group information 3 are the same as each other to thereby perform authenticity determination of the card 1. The authenticity determination group information 3 is read by a group information sensor 50. The authenticity determination group information 3 is read by the group information sensor 50 provided at the card guide unit 7 when the card 1 is guided and slid by the card guide unit 7. A group information acquisition unit that receives a signal of the group information sensor 50 and acquires group information of the plurality of cards 1 stored in the card housing unit 5 is provided in the control device 24. A group information determination unit that determines the authenticity of the plurality of cards stored in the card housing unit 5 is informed of an output of the group information acquisition unit. The group information determination unit determines whether or not predetermined group information is provided for each card, displays and outputs an authenticity result by the (output means) display devices 11 and 25, and sends it to the external central control pit. A light source for reading the authenticity determination group information 3 is provided integrally with the group information sensor 50 itself. In the embodiment, light sources (not shown) are LEDs (ultraviolet LEDs) that emit ultraviolet rays, and the LEDs of two types of different wavelengths are used.

The object detection sensor 23 is provided at an upstream (with respect to a slide direction S of the card) of the group information sensor 50, thus when the object detection sensor 23 detects the card 1, it issues a trigger signal indicating reading start, the light sources (not shown) of the group information sensor 50 emit two types of ultraviolet rays, the two types of ultraviolet rays are irradiated to the authenticity determination group information printed on the card 1, and the group information sensor 50 receives the light of different wavelength spectra emitted by the authenticity determination group information. The authenticity determination unit 9 is configured with an electronic circuit including a microcomputer, a memory, etc., and has a configuration of a usual computer, such as a CPU, a ROM, and a RAM. The authenticity determination unit 9 performs processing to determine the authenticity of the authenticity determination group information by executing a program stored in the ROM. The authenticity determination group information is checked, each pulled-out card 1 is determined whether to coincide with right authenticity determination group information, and if it does not coincide with the authenticity determination group information of a legitimate card, an alarm (a buzzer etc.) is sounded and a lamp indicating that an abnormal card has been drawn is lighted by the second output means 25.

In addition, the authenticity determination group information 3 may be mixed in infrared reactive ink or ultraviolet reactive ink for printing the code 2 for specifying the number (rank) of the card 1, and then may be printed. Although the authenticity determination group information is printed at the same position of the card 1 independently as described above at least in a set of cards, as the authenticity determination group information 3, it is also possible that the code is configured with a substance or a material, and that the substance or the material is configured to be contained in a coating paint or an anchor paint of the card 1, a back surface design printed on a surface of the card, a mark, an index, or ink in which the code indicating the number of marks is printed.

Figure 7:
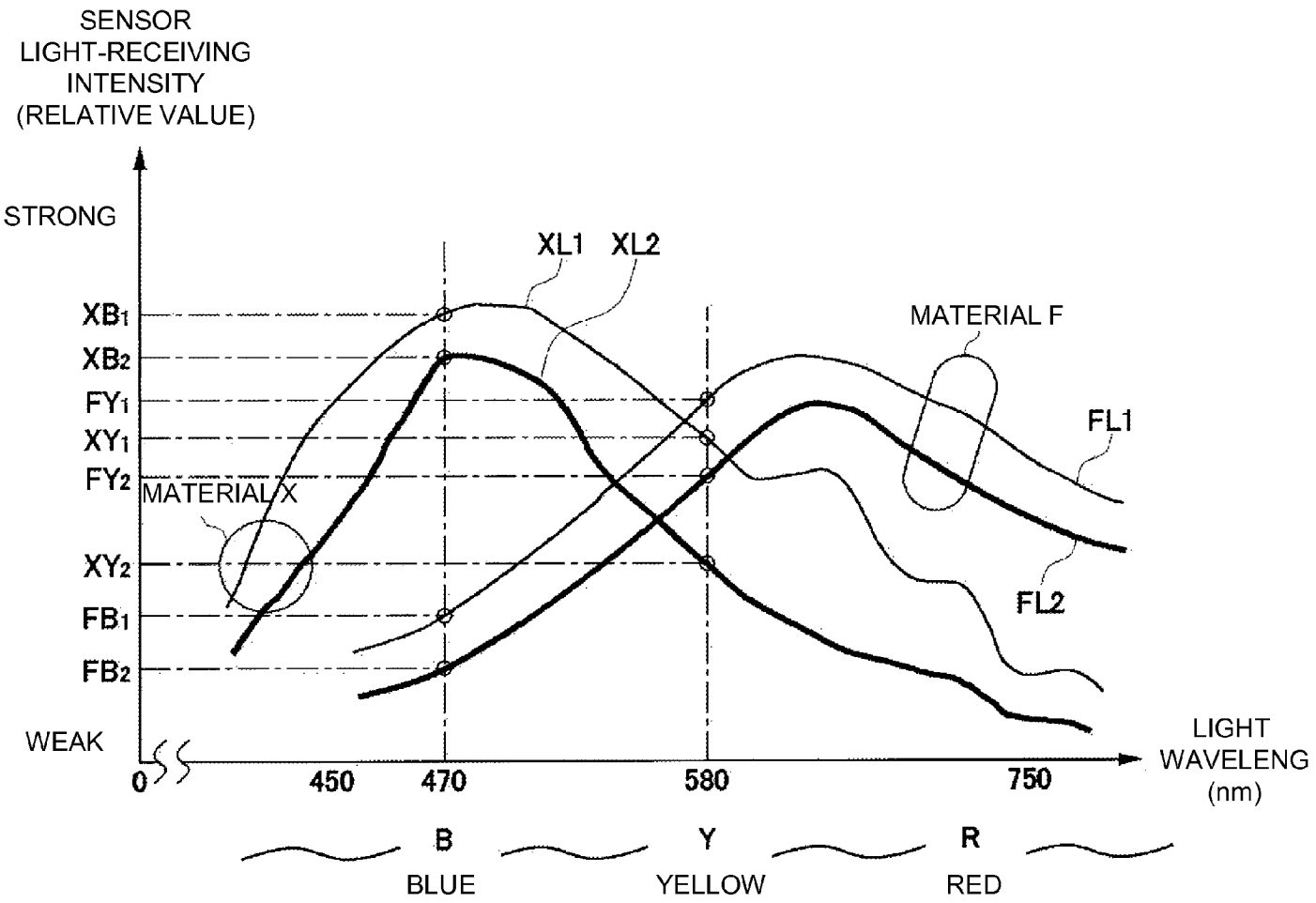
FIG. 7 is a graph showing relative values of intensities of emitted light obtained when ultraviolet rays of two types of wavelengths are irradiated to an authenticity determination code.

Next, processing that determines authenticity will be explained by FIG. 7. FIG. 7 shows relative intensities of spectra (intensity distribution of a wavelength of light) of emitted light obtained from the group information sensor 50 (a UV light sensor) when two types of ultraviolet rays (L1) and (L2) are irradiated to the authenticity determination group information. When a polymeric material X is used as authenticity determination group information indicating a proper card 1, a spectral curve obtained by irradiating the ultraviolet ray (L1) to the polymeric material X is set to be XL1, and a spectral curve obtained by irradiating the ultraviolet ray (L2) to the polymeric material X is set to be XL2. In this case, XB1 and XB2 are obtained as intensities of light in a blue predetermined wavelength region (for example, 470 nm). In addition, XY1 and XY2 are obtained as intensities of light in a yellow predetermined wavelength region (for example, 580 nm). When ratios of emission intensities in two particular wavelengths (for example, blue and yellow) of the two emitted light XL1, XL2 by the two ultraviolet rays (L1, L2) are determined, XR1=XB1/XY1 and XR2=XB2/XY2 are obtained, respectively. A molecular structure of the polymeric material X as the authenticity determination group information is designed so that the ratios XR1 and XR2 of the emission intensities in the two particular wavelengths (for example, blue and yellow) become different values, and thereby it is made as a proper code. In a manner as described above, the predetermined values XR1 and XR2 are obtained as determination codes (parameters) of the authenticity determination group information indicating the proper card 1. Since emission spectra to light of two wavelengths substantially coincide with each other in a common material having the other structure, authenticity of an authenticity code can be determined by examining whether the values XR1, XR2 of the ratios of the emission intensities in at least two particular wavelengths (for example, blue and yellow) differ from each other or substantially coincidence with each other.

The polymeric material X is printed on the proper card 1 as the authenticity determination group information. Next, a case where a improper card appears will be explained with reference to FIG. 6. It is assumed that authenticity determination group information is not provided in the improper card, or a pseudo improper code is attached thereto, and in this case, when a spectral curve obtained by irradiating the ultraviolet ray (L1) to the improper card is set to be FL1, and a spectral curve obtained by irradiating the ultraviolet ray (L2) to the improper card is set to be FL2, ratios of intensities in the above-described specified wavelengths of the emitted light by the two ultraviolet rays become FR1=FB1/FY1 and FR2=FB2/FY2, respectively. When the ratios are compared with a determination parameter of the authenticity determination group information indicating the proper card 1, both are different from each other, values of FR1 and FR2 become equal to each other or substantially equal to each other in a nature of a common substance, and thus it can be easily determined that the card is a improper. (Also when the authenticity code 3 is not attached, light-receiving intensities become equal to zero, and the values of both FR1 and FR2 become equal to each other. A spectrum of emitted light by light is specific to a substance, and is an individual specific property for each substance.

Meanwhile, when the polymeric material X is configured as the authenticity determination group information indicating the proper card 1, it is configured as a substance containing a substance (DNA etc.) having a particular sequence of a particular base, and thereby copying of a improper code is prevented. When a improper is produced, it is stochastically impossible to make the particular sequence of the particular base coincide with the others, and it becomes impossible to manufacture a same substance. In addition, a material configuring the authenticity determination group information may be mixed in ink in which a mark 101 (a suit and a rank) of all the cards including picture cards (J, Q, K) and an index 102 are printed, and thereby the authenticity determination group information may be configured. In this case, the group information sensor 50 is arranged so as to read the authenticity determination group information by the mark of the card 1, infrared reactive ink or ultraviolet reactive ink contained in ink in which the index 101 (the suit and the rank) has been printed. A light source having an invisible wavelength for reading the authenticity determination group information is provided integrally with the group information sensor 50 itself. In the embodiment, LEDs (ultraviolet ray emitting LEDs) that emit ultraviolet rays, i.e., the ultraviolet ray emitting LEDs of two types of different wavelengths are used as the light sources (not shown). The authenticity determination group information can also be configured so that a substance or a material is contained in a coating paint or an anchor paint of the card, a back surface design printed on a surface of the card, a mark, an index, or ink in which a code indicating the number of marks is printed, and in this case, the group information sensor 50 is arranged corresponding to a position where these codes can be read.

Group information indicating a set of the cards, may be the information for each deck of a set of cards 1, or the information of a plurality of deck units. As for group information, it is needless to say that group information may further be used other than information for each casino and table where the cards are used. The group information may further be group information whose type is different for each card provision source (a card shoe etc.), or different set codes may be set for each production lot or each casino where the cards are used.

Although in the above-described embodiment, the polymeric material X is printed on the proper card 1 as the authenticity determination group information, in order to configure a more complicated authenticity determination code, a structure may be employed where a set code having group information indicating a set of the card is further provided at the card, and where the above-described authenticity determination code is printed in the above-described set code. In this case, the set code may be read by a code reading unit that reads from the card a code indicating the number of the card, or a configuration may be employed in which the group information sensor 50 of the authenticity determination unit reads the set code from the authenticity determination code concerning the authenticity of the card, and determines and discriminates the set code in the authenticity determination unit.

In order to improve the embodiment and to configure the more complicated authenticity determination code, it is preferable that two or more types of substances, such as a polymeric material, are set, and the substances having different spectra of reflected light are combined and used, and that a complex thereof is set to be the authenticity determination code. The invisible ultraviolet reactive substance and the UV sensor that detects it are used in the embodiment, and authenticity determination group information is one example of the authenticity determination group information that cannot be read by human sense of vision and can be read under a predetermined condition. Accordingly, an invisible infrared reactive type substance may be employed. Authenticity determination group information can be used also as the information including information of a casino unit unique to a casino where the playing card is used, and information for each casino table or specific to a vender.

Next, there will be explained a substance that configures an authenticity determination code containing DNAs used for the present invention. The authenticity determination code containing DNAs is developed by nanotechnology and molecular science, and has a security function by invisible DNAs by combining DNAs to configure the authenticity determination code. A code by DNAs has a size from a single atom to a polymer, is a complex of chemical substances of approximately 0.5 to 5 microns, and there are almost infinite types (approximately not less than 30 trillions) of codes, and they can be easily produced or reproduced. In addition, a true authenticity determination code can also be concealed in a number of improper codes in order to prevent counterfeiting and reading. From a standpoint of a counterfeiter, first of all, it is almost impossible to copy a same code and additionally, it cannot be determined which is the true authenticity determination code, and thus security is high. In addition, an authenticity determination code by DNAs is transparent and invisible, and thus when the code is used by being mixed in transparent liquid or ink, a fact that the DNAs have been mixed is not usually determined. It is extremely difficult that only the authenticity determination code containing mixed-in or added DNAs is removed or inactivated, or that a function thereof is made to be lost.

Although the suitable embodiment of the present invention that can be considered at present has been explained hereinbefore, it is to be understood that various modifications can be made to the embodiment, and it is intended that accompanying claims include such all the modifications within the true spirit and the scope of the present invention.

INDUSTRIAL APPLICABILITY

Since a card shooter apparatus of a table game system according to the present invention can inspect that a plurality of cards complete a predetermined number (for example, 416 cards in a case of eight decks) in a state of being present in the card shooter apparatus, it is useful as a table game system etc. that are used in a casino etc.

REFERENCE SIGNS LIST

1 card, 2 code, 4 card shooter apparatus, 5 card housing unit, 6 game table of casino, 7 card guide unit, 8 code reading unit, 9 authenticity determination unit, 10 win or loss determination unit, 11 output means, 12 lid, 14 optical sensor, 15 playing card number counting unit, 16 scanning means

The invention claimed is:

1. A card shooter apparatus comprising:

a card shooter unit provided with a card housing unit that stores a plurality of cards in a horizontally stacking manner, and an opening through which the cards are slid and taken out onto a game table from the card housing unit;

an optical sensor that receives reflected light of light irradiated to end surfaces of the plurality of cards stored in the card housing unit;

a playing card number counting unit that receives a signal of the optical sensor to count the number of the plurality of cards stored in the card housing unit; and a number count determination unit that determines whether or not the number of the plurality of cards stored in the card housing unit completes a predetermined number by an output of the playing card number counting unit, and outputs a result, wherein the optical sensor is arranged at an upper part of the card housing unit, and is arranged over a stacking direction of the plurality of cards so as to be able to receive the reflected light from the end surfaces of the stored plurality of cards, and wherein the optical sensor is further provided with scanning means that moves the optical sensor.

2. The card shooter apparatus according to claim 1, wherein the playing card number counting unit is configured to decide the number of the plurality of cards based on information obtained from the optical sensor concerning minute gaps among the plurality of cards stored and stacked in the card housing unit or black portions that are present in the cards, or a relative difference in color from the minute gaps and the black portions.

3. The card shooter apparatus according to claim 1, further comprising:

a card reading unit that reads the number of cards from the cards pulled out from the card shooter unit; and win or loss determination means that determines win or loss of a card game based on information of the number of the plurality of cards from the card reading unit.

4. The card shooter apparatus according to claim 1, wherein the optical sensor and the scanning means are provided at a lid arranged at the upper part of the card housing unit.

5. The card shooter apparatus according to claim 1, wherein a display unit that displays a determination result by the number count determination unit is provided at the lid.

6. The card shooter apparatus according to claim 1, further comprising:

a side surface pattern storage device that stores a particular predetermined striped pitch or color that appears on side surfaces of the plurality of cards when the plurality of cards are stacked; and a fraudulent card detection unit that compares reflected light of light of the card side surfaces obtained from the optical sensor with the predetermined striped pitch or color, and determines whether or not a fraudulent card or a defective card is mixed in the plurality of cards stored in the card housing unit.

7. A table game system comprising:

cards configured so that a striped pattern appears on side surfaces of a plurality of cards when the plurality of cards are stacked; and a card shooter apparatus provided with a card housing unit that stores the plurality of cards in a stacking manner, and a card shooter unit that has an opening through which the cards are slid and taken out onto a game table from the card housing unit, wherein the card shooter apparatus includes:

a card shooter unit provided with the card housing unit that stores the plurality of cards in a horizontally stacking manner, and the opening through which the cards are slid and taken out onto the game table from the card housing unit;

an optical sensor that receives reflected light of light irradiated to end surfaces of the plurality of cards stored in the card housing unit;

a playing card number counting unit that receives a signal of the optical sensor to count the number of the plurality of cards stored in the card housing unit;

a number count determination unit that determines whether or not the number of the plurality of cards stored in the card housing unit completes a predetermined number by an output of the playing card number counting unit, and outputs a result;

a side surface pattern storage device that stores a particular predetermined striped pitch or color that appears on side surfaces of the plurality of cards when the plurality of cards are stacked; and a fraudulent card detection unit that compares reflected light of light of the card side surfaces obtained from the optical sensor with the predetermined striped pitch or color, and determines and outputs whether or not a fraudulent card or a defective card is mixed in the plurality of cards stored in the card housing unit, wherein the optical sensor is arranged at an upper part of the card housing unit, and is arranged so as to be able to receive the reflected light from the end surfaces of the stored plurality of cards, and wherein the optical sensor is further provided with scanning means that moves the optical sensor.

8. The table game system according to claim 7, further comprising:

a group information sensor that acquires group information attached to the cards stored in the card housing unit in particular ink; and a group information determination unit that receives a signal of the group information sensor, determines whether or not the plurality of cards stored in the card housing unit are provided with predetermined group information by the group information of the plurality of cards stored in the card housing unit, and outputs a result.

9. The table game system according to claim 8, wherein the optical sensor, the scanning means, and the group information sensor are provided at the lid arranged at the upper part of the card housing unit.

10. The table game system according to claim 7, wherein the playing card number counting unit is configured to decide the number of the plurality of cards based on information obtained from the optical sensor concerning minute gaps among the plurality of cards stored and stacked in the card housing unit or black portions that are present in the cards, or a relative difference in color from the minute gaps and the black portions.

11. The table game system according to claim 7, further comprising:

a card reading unit that reads the number of cards from the cards pulled out from the card shooter unit; and win or loss determination mean that determines win or loss of a card game based on information of the number of the plurality of cards from the card reading unit.

12. The table game system according to claim 7, wherein the optical sensor and the scanning means are provided at a lid arranged at the upper part of the card housing unit.

13. The table game system according to claim 7, wherein a display unit that displays a determination result by the number count determination unit is provided at the lid.

14. The table game system according to claim 7, further comprising communication means, wherein the communication means is provided with a function to transmit the determination result by the number count determination unit, and a determination result by the fraudulent card detection unit.

15. A card inspection apparatus comprising:

a card housing unit that stores a plurality of cards in a horizontally stacking manner;

an optical sensor that receives reflected light of light irradiated to end surfaces of the plurality of cards stored in the card housing unit;

a playing card number counting unit that receives a signal of the optical sensor to count the number of the plurality of cards stored in the card housing unit; and a number count determination unit that determines whether or not the number of the plurality of cards stored in the card housing unit completes a predetermined number by an output of the playing card number counting unit, and outputs a result, wherein the optical sensor is arranged at an upper part of the card housing unit, and is arranged over a stacking direction of the plurality of cards so as to be able to receive the reflected light from the end surfaces of the stored plurality of cards, and wherein the optical sensor is further provided with scanning means that moves the optical sensor.

16. The card inspection apparatus according to claim 15, wherein the playing card number counting unit is configured to decide the number of the plurality of cards based on information obtained from the optical sensor concerning minute gaps among the plurality of cards stored and stacked in the card housing unit or black portions that are present in the cards, or a relative difference in color from the minute gaps and the black portions.

17. The card inspection apparatus according to claim 15, wherein the optical sensor and the scanning means are provided at a lid arranged at the upper part of the card housing unit.

18. The card inspection apparatus according to claim 15, wherein a display unit that displays a determination result by the number count determination unit is provided at the lid.

19. The card inspection apparatus according to claim 15, further comprising:

a side surface pattern storage device that stores a particular predetermined striped pitch or color that appears on side surfaces of the plurality of cards when the plurality of cards are stacked; and a fraudulent card detection unit that compares reflected light of light of the card side surfaces obtained from the optical sensor with the predetermined striped pitch or color, and determines whether or not a fraudulent card or a defective card is mixed in the plurality of cards stored in the card housing unit.

20. A table game system comprising:

cards configured so that a striped pattern appears on side surfaces of a plurality of cards when the plurality of cards are stacked; and a card inspection apparatus provided with a card housing unit that stores the plurality of cards in a stacking manner, wherein the card inspection apparatus includes:

a card housing unit that stores the plurality of cards in a horizontally stacking manner;

an optical sensor that receives reflected light of light irradiated to end surfaces of the plurality of cards stored in the card housing unit;

a playing card number counting unit that receives a signal of the optical sensor to count the number of the plurality of cards stored in the card housing unit;

a number count determination unit that determines whether or not the number of the plurality of cards stored in the card housing unit completes a predetermined number by an output of the playing card number counting unit, and outputs a result;

a side surface pattern storage device that stores a particular predetermined striped pitch or color that appears on side surfaces of the plurality of cards when the plurality of cards are stacked; and a fraudulent card detection unit that compares reflected light of light of the card side surfaces obtained from the optical sensor with the predetermined striped pitch or color, and determines and outputs whether or not a fraudulent card or a defective card is mixed in the plurality of cards stored in the card housing unit, wherein the optical sensor is arranged at an upper part of the card housing unit, and is arranged so as to be able to receive the reflected light from the end surfaces of the stored plurality of cards, and wherein the optical sensor is further provided with scanning means that moves the optical sensor.

21. The table game system according to claim 20, further comprising:

a group information sensor that acquires group information attached to the cards stored in the card housing unit in particular ink; and a group information determination unit that receives a signal of the group information sensor, determines whether or not the plurality of cards stored in the card housing unit are provided with predetermined group information by the group information of the plurality of cards stored in the card housing unit, and outputs a result.

22. The table game system according to claim 20, wherein the playing card number counting unit is configured to decide the number of the plurality of cards based on information obtained from the optical sensor concerning minute gaps among the plurality of cards stored and stacked in the card housing unit or black portions that are present in the cards, or a relative difference in color from the minute gaps and the black portions.

23. The table game system according to claim 20, wherein the optical sensor and the scanning means are provided at a lid arranged at the upper part of the card housing unit.

24. The table game system according to claim 20, wherein a display unit that displays a determination result by the number count determination unit is provided at the lid.

25. The table game system according to claim 20, wherein the optical sensor, the scanning means, and the group information sensor are provided at the lid arranged at the upper part of the card housing unit.

26. The table game system according to claim 20, further comprising communication means, wherein the communication means is provided with a function to transmit the determination result by the number count determination unit, and a determination result by the fraudulent card detection unit.

* * * * *